US006311459B1

(12) United States Patent
Rossi

(10) Patent No.: US 6,311,459 B1
(45) Date of Patent: Nov. 6, 2001

(54) DEVICE AND METHOD FOR LOADING FILM ON MACHINES FOR WRAPPING PRODUCTS

(75) Inventor: Bruno Rossi, Rimini (IT)

(73) Assignee: Robopac S.A. (SM)

( * ) Notice: Subject to any disclaimer, the term of this patent is extended or adjusted under 35 U.S.C. 154(b) by 0 days.

(21) Appl. No.: 09/508,711

(22) PCT Filed: Jul. 21, 1999

(86) PCT No.: PCT/IB99/01304

§ 371 Date: Mar. 15, 2000

§ 102(e) Date: Mar. 15, 2000

(87) PCT Pub. No.: WO00/06452

PCT Pub. Date: Feb. 10, 2000

(30) Foreign Application Priority Data

Jul. 30, 1998 (IT) ..... BO98A0472

(51) Int. Cl.[7] ..... B65B 41/16

(52) U.S. Cl. ..... 53/389.2; 53/556; 53/587; 242/419.6; 242/419.8

(58) Field of Search ..... 53/556, 587, 389.3, 53/389.4; 242/419.6, 419.8, 419.9

(56) References Cited

U.S. PATENT DOCUMENTS 4,336,679 * 6/1982 Lancaster et al. ..... 53/399
4,458,467 * 7/1984 Shulman et al. ..... 53/399
5,414,979 * 5/1995 Moore et al. ..... 53/556

FOREIGN PATENT DOCUMENTS

A1-0220712 * 5/1987 (EP) ..... B65B/11/02
0237649 * 9/1987 (EP) ..... B65B/11/04
0774412-A1 * 5/1997 (EP) ..... B65B/11/02
WO-90/06261 * 6/1990 (FR) ..... B65B/11/02

* cited by examiner

*Primary Examiner*—Peter Vo
*Assistant Examiner*—Hemant M. Desai
(74) *Attorney, Agent, or Firm*—Fay, Sharpe, Fagan, Minnich & McKee, LLP

(57) ABSTRACT

In a device for loading film (3) on machines for wrapping groups of products, there is an area (H) designed to allow the free passage of the film (3) and located between a drive carriage (4) and one end (6*a*, 7*a*) of each of the film (3) feed rollers (6, 7). This area is defined by an extension of each roller (6, 7) and is tapered in relation to the circumference of the rollers. The film (3) can pass freely when it has a narrow configuration, in the form of a tongue (C), and when the free end (3*a*) of the film (3) is inserted and fed along a path (P) parallel to an original feed path. In the area (H) there are means (8) on which the tongue (c) can slide and which guide the tongue onto the contact and sliding surfaces (6*s*, 7*s*) of the rollers (6, 7). The invention also concerns a method for loading the film (3).

9 Claims, 4 Drawing Sheets

DEVICE AND METHOD FOR LOADING FILM ON MACHINES FOR WRAPPING PRODUCTS

TECHNICAL FIELD

The present invention relates to a device and a method for loading film on machines for wrapping products.

BACKGROUND ART

Current wrapping or banding machines (both automatic and semi-automatic) for groups of products consist basically of a table for the groups of products (which may be rotary or fixed) and a structure that mounts the film feed means. This mounting structure may (in the case of a rotary table) consist of a simple vertical column on which a film feed unit runs in both directions or (usually, in the case of a fixed table) it may be equipped with horizontal arms or prongs that rotate around the group of products.

The film feed means consist of a film roll rotatably mounted on a vertical shaft connected to a plate that forms part of a carriage that mounts the film feed means. In addition to the roll, there is a plurality of rollers, also vertical, connected to the plate and designed to guide the film and keep it stretched as it is fed towards the group of products.

Besides these elements, more and more banding machines are now equipped with motor-driven units for pre-stretching the wrapping film, especially when cold stretch film is used. Pre-stretching increases the stabilizing effect of the film and proportionally reduces the weight of the film on each banded group of products.

To correctly stretch the film being fed so that it does not slip on the rollers and so that, in particular, the width of the film band is not reduced (thus cancelling the film weight reducing effect), it is necessary to provide at least one pair of additional rollers, driven by independent motors so as to have different peripheral speeds, placed very close to each other and with the wrapping film making a very large angle round the two rollers.

This means that, in addition to the existing structure of the feed means, the film feed unit must be equipped with a large number of closely spaced rollers on the film feed carriage. As a result of this structure, it is often very difficult for the operator to load the film (when the roll finishes or the film breaks) because there is very little space between the rollers and there is the risk of the operator crushing his fingers when inserting the end of the film manually between the rollers.

In one solution devised by the manufacturers of these machines to overcome this problem, the carriage mounting the film roll and the pre-stretch and guide rollers is made using only one mounting bracket in such a way that the carriage is offset This structure partly solves the problem of loading the film between the rollers (one end of the rollers is free) but necessitates precise dimensioning of the only supporting part and considerable stiffening of the rollers (since there is only one supporting point) and hence greatly increases the costs of the machine and renders assembly more complex.

Another solution designed to solve the above mentioned problem was to divide the mounting carriage into two parts, a fixed part and a moving part, that can rotate about a horizontal or vertical pivot axis. In this way, the operator can load the film by turning the moving part and feeding the end of the film into the free area from the fixed part.

The disadvantage of the second solution is that the carriage is larger and heavier because it is divided into two and thus requires suitable lifting means and increases the production costs of the unit. Moreover, in this solution, the rollers must be placed further apart and the angles of the wrapping film round the rollers must be reduced, thus reducing the quality of the pre-stretching operation.

DISCLOSURE OF THE INVENTION

The aim of the present invention is to overcome the above mentioned disadvantages by providing a device and related method for loading film on wrapping machines which simplifies the stage of inserting the film without substantially modifying the structure of the standard feed carriage already used on wrapping machines.

BRIEF DESCRIPTION OF DRAWINGS

The technical characteristics of the invention according to the above mentioned aims are described in the claims below and the advantages of the invention will become more apparent from the detailed description which follows, with reference to the accompanying drawings, which illustrate a preferred embodiment of the invention and in which:

DETAILED DESCRIPTION OF THE DRAWINGS

Figure 1:
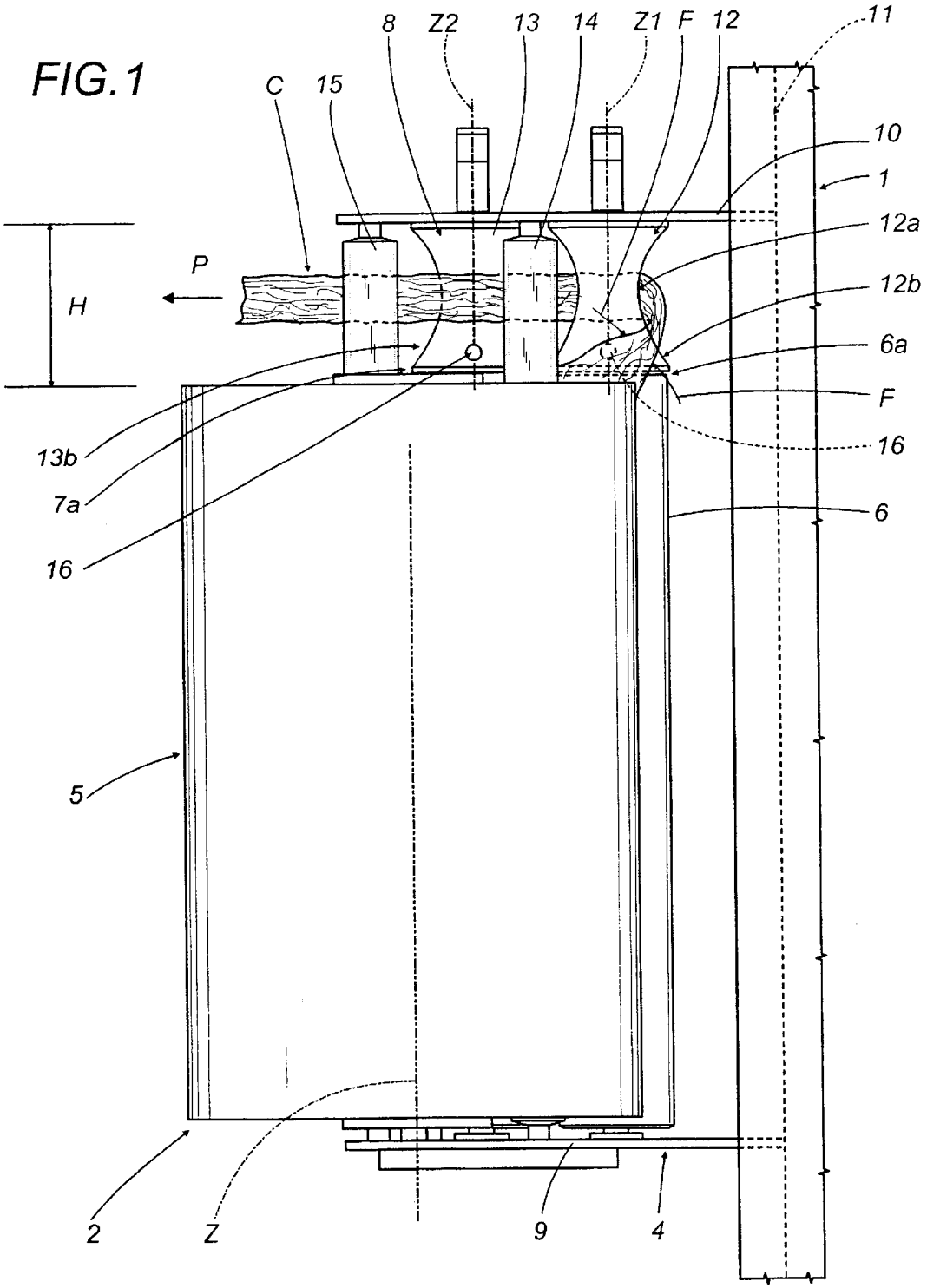
FIG. 1 is a schematic side view, with some parts cut away in order to better illustrate others, of a film feed carriage forming part of a wrapping machine equipped with the film loading device made according to the present invention.

With reference to the accompanying drawings, in particular FIG. 1, a device for loading film according to the present invention is used on machines, whether automatic or semiautomatic, for wrapping groups of palletized products.

Machines of this type, of which we shall describe only the parts relating to the invention, since the other parts are well known to experts in the trade, comprise a frame 1 that mounts a unit 2 for preparing and feeding the film 3 to be wrapped around the group of products (not illustrated).

The feed unit 2 comprises a carriage 4 that rotatably mounts a roll 5 of film 3 that can turn freely about a vertical axis Z. Close to the roll 5, there is a plurality of rollers: in the preferred embodiment described here, two of these rollers, labelled 6 and 7, are used to pre-stretch the film 3 before wrapping the products, are driven independently of each other by separate motors and rotate about their axes Z1 and Z2 which are parallel to the axis Z of the roll 5; the numerals 14 and 15 indicate two idle guide rollers designed to enable the film 3 to be properly unwound before and after it passes between the pre-stretch rollers 6 and 7.

Figure 3:
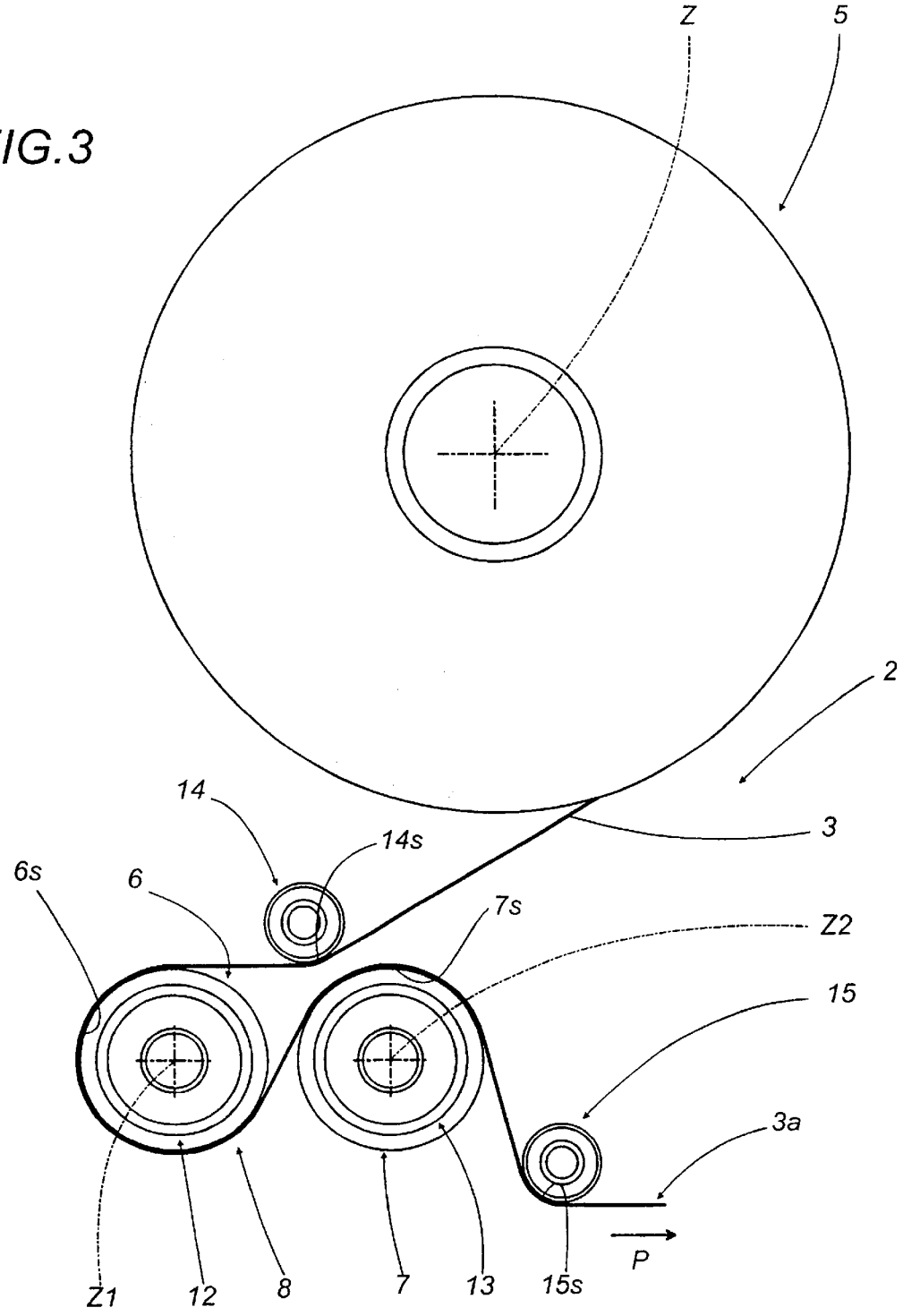
FIG. 3 shows, in a top plan view, the feed and pre-stretching path followed by the film on the feed carriage illustrated in previous figures.

Both the rollers 6 and 7 and the guide rollers 14 and 15 are connected at both ends to the carriage 4 at positions such as to allow the film 3, having a defined width L, to move along a feed path defined by a part of their lateral or contact surfaces 6*s*, 7*s*, 14*s*, 15*s* (the path is illustrated in FIG. 3).

Figure 2:
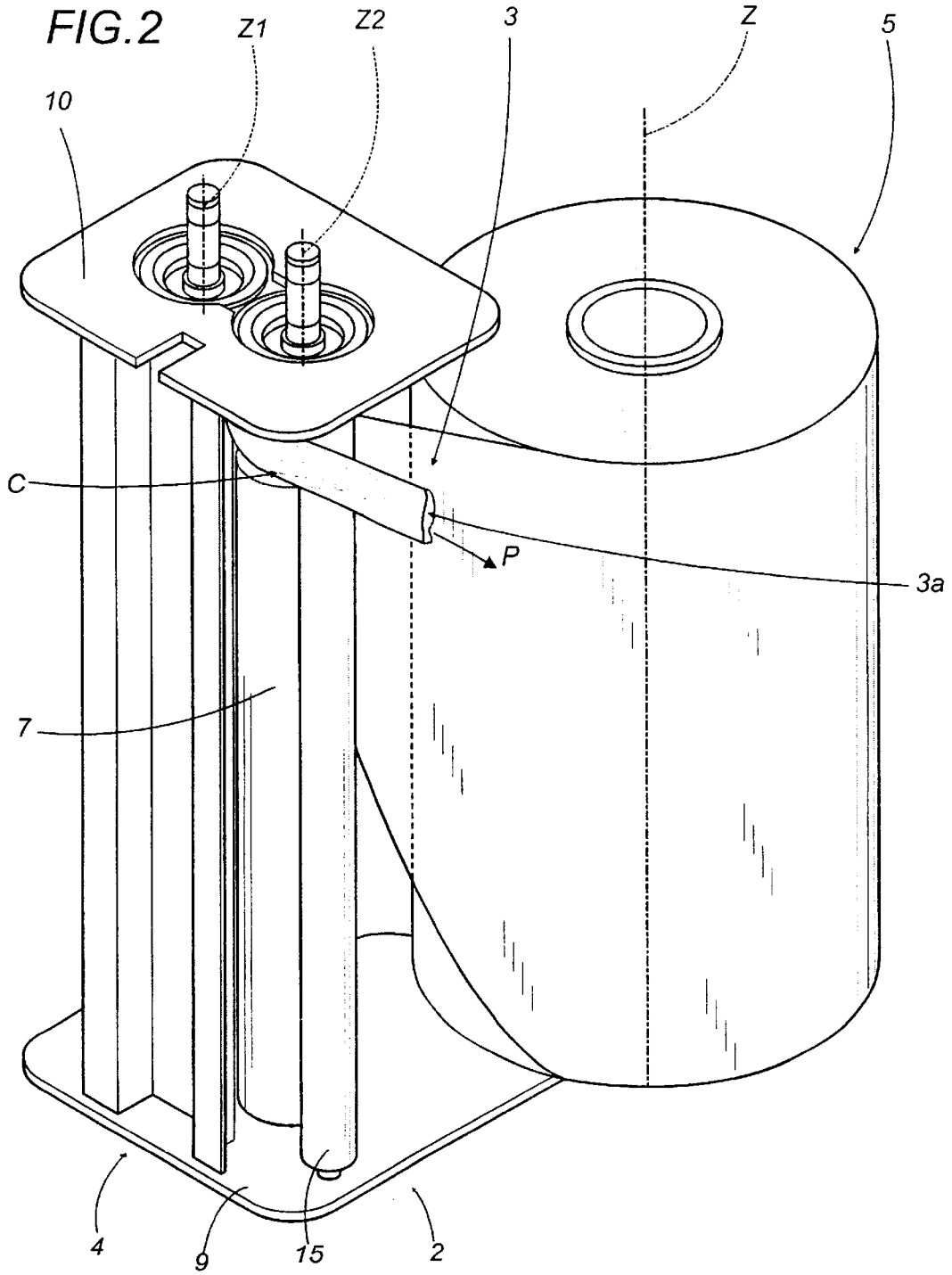
FIG. 2 is a perspective view, with some parts cut away in order to better illustrate others, of the carriage shown in FIG. 1.
Figure 4:
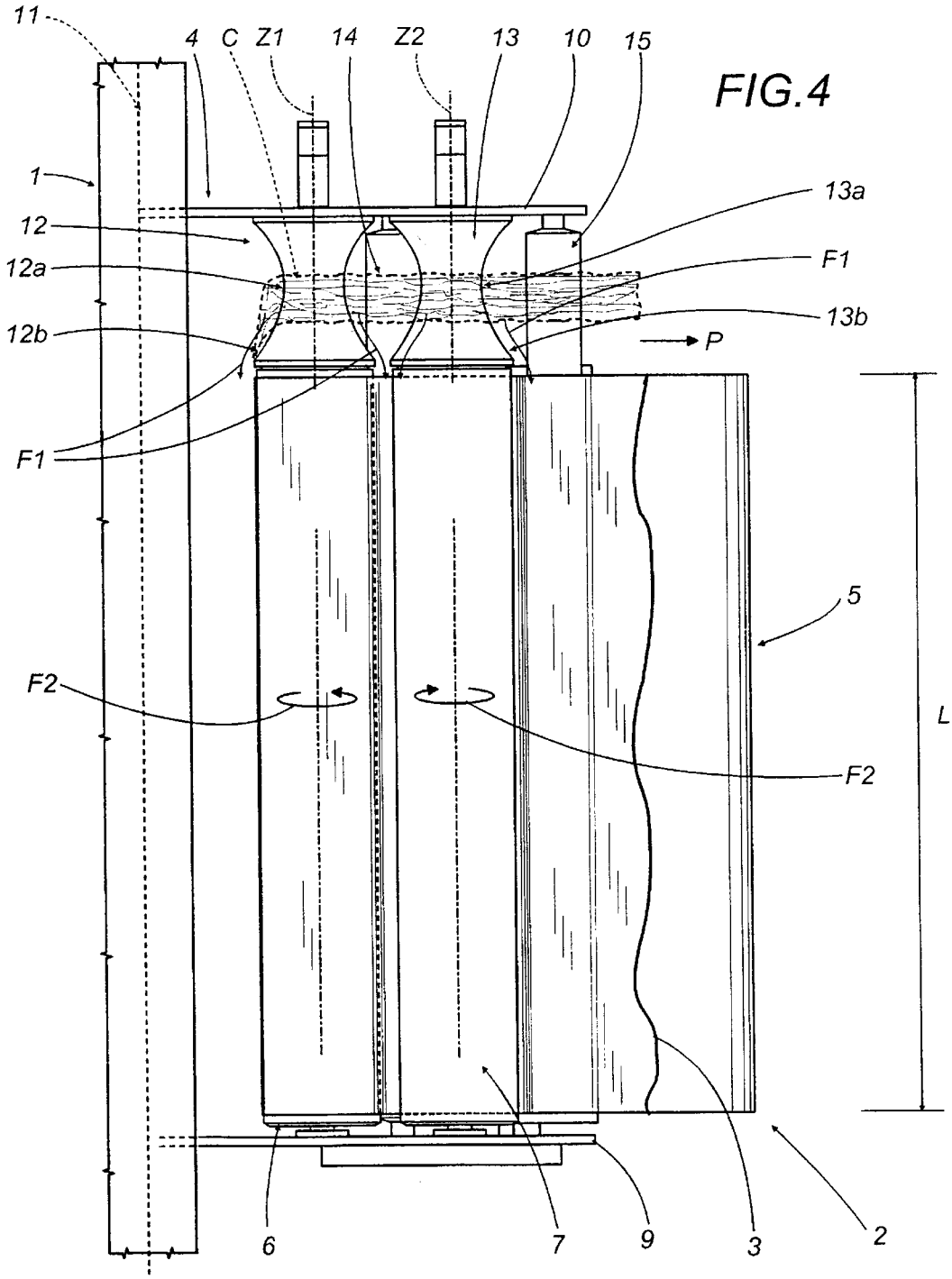
FIG. 4 is a schematic front view of two pre-stretch rollers forming part of the feed carriage illustrated in the previous figures.

As shown clearly in FIGS. 1, 2 and 4, between the carriage 4 and one end 6*a*, 7*a* of each of the pre-stretch rollers 6 and 7, there is an area H designed to allow the free passage of the film 3, said area H being defined by a direct extension of each pre-stretch roller 6 and 7. The extension is tapered in relation to the circumference of the pre-stretch rollers.

The film 3 can pass freely through the area H when it has a narrow configuration, in the form of a tongue C, and when it is necessary to load the film onto the machine (because the film is broken or the roll is finished) by inserting a free end 3*a* of the film 3 and feeding it along a path (indicated by the arrow P in FIG. 3) parallel to the previously mentioned feed path.

The free passage area H comprises means 8 on which the tongue C being unwound can slide and which guide the tongue onto the contact and sliding surfaces 6*s*, 7*s* of the pre-stretch rollers 6, 7 so as to be able to stretch the film 3 when the rollers are started up again (as described in more detail below).

Looking in more detail, these guide and slide means 8 are formed from the above mentioned extensions of the pre-stretch rollers 6 and 7.

As is clearly illustrated in FIGS. 1 and 4, the mounting carriage 4 consists of a first, lower horizontal plate 9 and a second, upper horizontal plate 10, to which the rollers 6, 7, 14 and 15 and the roll 5 are linked. The plates 9 and 10 are both connected to a structure 11 that mounts and drives the carriage 4 and that is built into the machine frame 1. In the preferred embodiment, the guide means 8 on the structure of the carriage 4 are placed between the second, upper plate 10 and the corresponding top end 6*a* and 7*a* of each pre-stretch roller 6 and 7.

To be able to form an area of free passage between the rollers 6 and 7 and the second plate 10, the guide and slide means 8 of the tongue C consist of a reel 12 and 13 for each roller 6 and 7. Each reel 12 and 13 has the shape of a double truncated cone, so as to create a minimum diameter area 12*a* and 13*a* at the centre of each reel, which forms a horizontal sliding surface for the tongue C, and at least one area 12*b*, 13*b* below the passage area, angled outwards to form a inclined surface that connects with the corresponding roller 6 and 7 and guides the tongue C towards the corresponding roller 6 and 7.

Each reel 12 and 13 is keyed to the corresponding roller 6 and 7 with screw means 16 so that it can turn together with the shaft when the film 3 is being extended.

In practice, the method to load the film 3 on the pre-stretch rollers 6 and 7 using the device just described comprises the following steps:

reducing the width of the end 3*a* of the film 3 so as to form a narrow tongue C, done manually by the machine operator (see arrow F in FIG. 1);

manually pulling the tongue C thus obtained in direction P (see arrow P in FIGS. 1 to 4), parallel to the feed and pre-stretch path, through the area H of free passage between the second, upper plate 10 of the carriage 4 and the end 6*a* and 7*a* of each pre-stretch roller 6 and 7, that is, along the central areas 12*a* and 13*a* of the reels 12 and 13;

extending the film 3 to its original width L again (see arrows F1 in FIG. 4) when the rollers 6 and 7 and the reels 12 and 13 start rotating (see arrows F2 in FIG. 4) so that the areas 12*b* and 13*b* of the reels 12 and 13 connecting with the rollers 6 and 7 extend the film 3 downwards onto the rollers.

The device made as described above and the related method therefore achieve the above mentioned aims through a simple mechanism which can be applied without substantially modifying the structure of the standard feed carriage already used on wrapping machines, since the special shape of the reels not only enables the tongue to feed along its path but also allows the film to slide onto the rollers without the operator's having to work on the film manually.

This makes it extremely quick and easy to insert or re-insert the end of the film roll. The film returns to its standard width surely and easily since the operator need not do anything when the rollers start rotating again.

The present invention may be subject to numerous modifications and variations, all encompassed by the original design concept. Moreover, all components may be replaced with technically equivalent parts.

What is claimed is:

1. A device for loading film on machines for wrapping groups of products, said machines comprising a frame (1) that mounts a unit (2) for preparing and feeding the film (3) to be wrapped around the group of products; the unit (2) comprising a carriage (4) that rotatably mounts a roll (5) of film (3) turning freely about a vertical axis (Z), and at least one pair of motor-driven rollers (6, 7) rotating about their axes (Z1, Z2), which are parallel to the axis (Z) of the roll (5), connected at both ends to the carriage (4) and designed to allow the film (3), having a defined width (L), to move along a feed path defined by a part of their lateral or contact surfaces (6*s*, 7*s*), wherein between the carriage (4) and one of the ends (6*a*, 7*a*) of each of the rollers (6, 7) there is an area (H) for the free passage of the film (3), defined by an extension of each of said rollers (6, 7), the extension being tapered in relation to the circumference of the rollers, allowing the film (3) to pass through when it has a narrow configuration, in the form of a tongue (C), and when a free end (3*a*) of the film (3) is inserted and fed along a path (P) parallel to the previously mentioned feed path; the free passage area (H) comprising means (8) on which the tongue (C) being unwound can slide and which guide the tongue onto the contact and sliding surfaces (6*s*, 7*s*) of the rollers (6, 7).

2. The device according to claim 1, wherein the guide and slide means (8) are formed from the extensions of the rollers (6, 7).

3. The device according to claim 2, wherein the guide and slide means (8) consist of a reel (12, 13) for each roller (6, 7) located between each upper end (6*a*, 7*a*) of the corresponding roller (6, 7) and the second, upper plate (10).

4. The device according to claim 1, where the carriage (4) consists of a first, lower horizontal plate (9) and a second, upper horizontal plate (10) connected to a structure (11) that mounts and drives the carriage, wherein guide and slide means (8) are formed from the extensions of the rollers (6, 7) and are located between the second, upper plate (10) and the corresponding top end (6*a*, 7*a*) of each roller (6, 7).

5. The device according to claim 4, wherein the guide and slide means (8) consist of a reel (12, 13) for each roller (6, 7) located between each upper end (6*a*, 7*a*) of the corresponding roller (6, 7) and the second, upper plate (10).

6. The device according to claim 1, wherein the guide and slide means (8) consist of a reel (12, 13) for each roller (6, 7) located between each upper end (6*a*, 7*a*) of the corresponding roller (6, 7) and the second, upper plate (10).

7. The device according to claim 6, wherein each reel (12, 13) has the shape of a double truncated cone, so as to create a minimum diameter area (12*a*, 13*a*) at the centre of each reel, which forms a horizontal sliding surface for the tongue (C), and an area (12*b*, 13*b*) below the passage area, angled outwards to form an inclined surface that connects the reels (12, 13) to the rollers (6, 7) and guides the tongue (C) towards the corresponding roller (6, 7).

8. The device according to claim 6, wherein each reel (12, 13) is keyed to, and can turn together with, the corresponding roller (6, 7).

9. A method to load film on machines for wrapping groups of products, said machines comprising a frame (1) that mounts a unit (2) for preparing and feeding the film (3) to be wrapped around the group of products; the unit (2) comprising a carriage (4) that rotatably mounts a roll (5) of film (3) turning freely about a vertical axis (Z), and at least one pair of motor-driven rollers (6, 7) rotating about their axes (Z1, Z2), which are parallel to the axis (Z) of the roll (5), connected at both ends to the carriage (4) and designed to allow the film (3), having a defined width (L), to move along a feed path defined by a part of their lateral or contact surfaces (6*s*, 7*s*), the method it comprises the following steps:

reducing the width of the end (3*a*) of the film (3) so as to form a narrow tongue (C);

pulling the tongue (C) thus obtained in a direction parallel to the feed path, through the area (H) of free passage between the carriage (4) and one end (6*a*, 7*a*) of each of said rollers (6, 7);

extending the film (3) to its original width (L) using the guide means (8), which are made on each of said rollers (6, 7) and which form an inclined surface that guides the tongue (C) onto the rollers (6, 7) when said rollers start rotating.

* * * * *